United States Patent [19]

Womack et al.

[11] Patent Number: 4,955,262

[45] Date of Patent: Sep. 11, 1990

[54] SOCKET PIPE WRENCH

[76] Inventors: Kent Womack, Rte. 2, Box 52, Chillicothe, Tex. 79225; Tony Hise, Box 211, Dumas, Tex. 79029

[21] Appl. No.: 349,574

[22] Filed: May 9, 1989

Related U.S. Application Data

[63] Continuation-in-part of Ser. No. 323,167, Mar. 15, 1989, Pat. No. 4,920,834, which is a continuation of Ser. No. 98,278, Sep. 18, 1987, abandoned.

[51] Int. Cl.[5] ..... B25B 13/16

[52] U.S. Cl. ..... 81/165; 81/126

[58] Field of Search ..... 81/126, 128, 129, 165 R, 81/176.2, 175, 53.2

[56] References Cited

U.S. PATENT DOCUMENTS 1,195,901 8/1916 Barrett ..... 81/53.2

1,279,349 9/1918 Johnson ..... 81/53.2

*Primary Examiner*—Frederick R. Schmidt

*Assistant Examiner*—Lawrence Cruz

*Attorney, Agent, or Firm*—Gunn, Lee & Miller

[57] ABSTRACT

A socket for tightening and loosening objects having a generally cylindrical section. The socket has a sliding jaw therein which grabs the object to be twisted similar to a pipe wrench. The socket has small teeth on the inner wall to allow it to grab bolts and nuts regardless of the shape thereof (hexagonal or square), and can even grab worn down bolts and nuts. The jaw is crescent shaped, wedged. A cam along the inside of the socket assists the grabbing action of the jaw.

12 Claims, 3 Drawing Sheets

SOCKET PIPE WRENCH

BACKGROUND OF THE INVENTION

Reference to Prior Patents:

This application is a continuation-in-part of application Ser. No. 07/323,167 filed May 15, 1989, now U.S. Pat. No. 4,920,834 which is a continuation of application Ser. No. 07/098,278 filed Sept. 18, 1987, now abandoned.

FIELD OF THE INVENTION

The present invention generally relates to hand tools, and more particularly to a socket device capable of being attached to a ratchet handle and being used to grip and turn machine nuts of variable size or shapes as well as pipes.

DESCRIPTION OF THE PRIOR ART

A standard method of mechanically attaching solid objects to one another so that they might be easily put together and taken apart is through the use of threaded nuts and bolts. The most common designs for nuts and bolts employ either a hexagonal or a square head adapted to accommodate an appropriate wrench as a tool for attachment and removal. Because of the great variety of mechanical applications, nuts and bolts must necessarily be of many different sizes. For the mechanic or technician who must work with these nuts and bolts, these variations in size create a need for a corresponding variety of tools. In addition to this demand, a mechanic is often presented with a nut or bolt that has had its head mutilated by use. In such a condition, the nut or bolt will fail to properly engage a tool of any size.

The tools designed to accommodate nuts and bolts are generally classified as wrenches (also known as spanners). Pliers may also be used to twist fasteners having a generally circular section but these are considered by most craftsman to be a tool separate and apart from wrenches. There are two broad categories into which most wrenches fall: those with crescent shaped designs and those with sockets. Crescent type wrenches may be of a fixed size or variable size. The jaws of a variable (or adjustable) wrench may be either flat or toothed. Toothed jaws are designed to accommodate either pipes or nuts and bolts which have lost their corners. Open-ended wrenches are of the crescent type.

Socket type wrenches come in only fixed sizes. A socket wrench set is usually composed of a single ratchet handle and a range of attachable sockets. These sockets are designed to be used with nuts and bolts of a specific size and shape, and as a rule do not function when the size or shape deviates significantly from the standard nut or bolt. Heretofore, sockets have always been made with smooth interior faces and do not grip worn nuts and bolts, or rounded pipe ends. Box wrenches and nut drivers are of the socket type.

Each of these designs has advantages and disadvantages. Crescent shaped wrenches generally must be removed from the nut or bolt each time a turn is made. Socket wrenches overcome this limitation by employing a ratchet mechanism that allows continuous contact with the nut. Conversely, sockets have the drawback of requiring some minimum clearance above the nut.

Special tools have been designed to overcome some of these problems. For example, U.S. Pat. No. 1,576,918 issued to Lidell on Mar. 16, 1926, depicts a crescent wrench having a cam-type toothed member adjustably mounted in the jaw of the wrench. This gives the wrench a ratchet like effect as well as allowing use on irregularly shaped objects. Another tool, shown in U.S. Pat. No. 3,425,302 issued to Davis on Feb. 4, 1969, has a special shim inside the jaw which may be adjusted to three different settings so as to vary the effective distance between the jaw members, thus accommodating different sizes of nuts or bolts. A third device, disclosed in U.S. Pat. No. 3,877,328 issued to Sullivan on Apr. 15, 1975, uses standard hexagonal sockets but with special inserts permitting use of the device on different sizes of nuts and bolts.

The foregoing patented wrenches still have certain disadvantages. The Davis and Sullivan devices require the use of a small implement which must be attached to the primary tool and properly adjusted. As any mechanic knows, it is oftentimes difficult to piece together such tools when the user is in cramped quarters (e.g. underneath a car). It would be easier to simply use a set of wrenches or sockets having variable sizes. Also, these small inserts may be easily lost. The Lidell wrench, due to the tooth pattern on opposing jaw members, makes it difficult to remove the tool from the fastener being turned. Lidell also does not have the standard capability of sockets to reach nuts and bolts located down narrow wells and the like. It would, therefore, be desirable and advantageous to devise a tool overcoming the limitations, which can be easily used on nuts and bolts or pipes of varying sizes and shapes.

SUMMARY OF THE INVENTION

Accordingly, the primary object of the present invention is to provide a tool which may be used to attach and remove nuts and bolts or the like.

Another object of the invention is to provide such a tool which may also be used on pipes or other members having a smooth outer surface.

Still another object of the invention is to provide such a tool which may accommodate a range of sizes and shapes of nuts and bolts.

Yet another object of the invention is to provide a socket having these advantages which is usable on prior art ratchet handles.

A further object is to provide such a socket which requires no special adjustments for use.

The foregoing objects are achieved in a socket having a self-adjusting jaw member therein. The jaw member has an eccentric profile, and is slidably mounted along the circumferential surface of the socket. A portion of the inner surface of the socket may protrude slightly inward to provide a camming action as the jaw member slides adjacent thereto.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of illustrative embodiments when read in conjunction with the accompanying drawings wherein:

DESCRIPTION OF THE PREFERRED EMBODIMENTS

Figure 1:
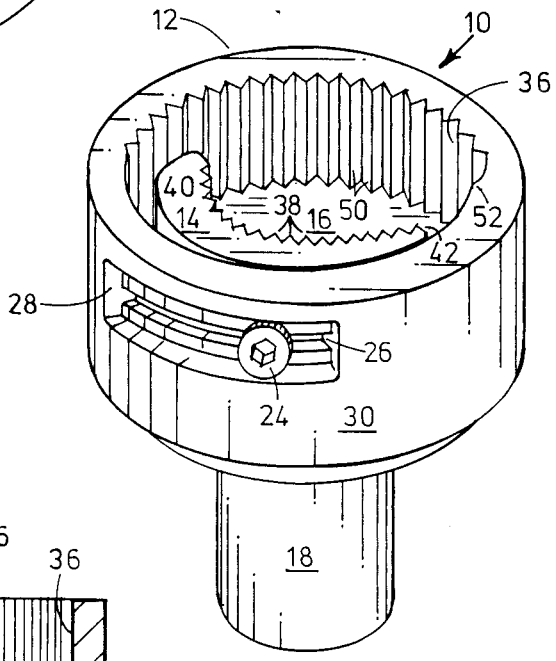
FIG. 1 is a perspective view of the pipe wrench socket of the present invention.
Figure 3:
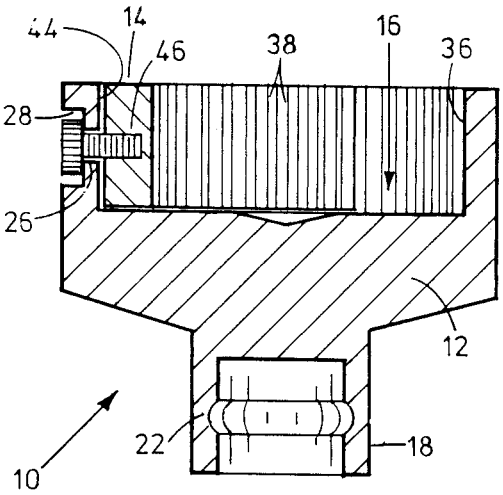
FIG. 3 is a cross-section of the pipe wrench socket taken along lines 3—3 of FIG. 2.

With reference now to the figures, and in particular with reference to FIG. 1, there is depicted the socket pipe wrench 10 of the present invention. Wrench 10 is generally comprised of a socket head 12 and a jaw 14. Socket head 12 is generally cylindrical in shape, and has a cavity 16 on one side for receiving the fastener or pipe to be manipulated, and a female coupler 18 on the other side for receiving a ratchet drive plug (shown as reference numeral 20 in FIG. 4). Coupler 18 preferably has an annular indented ring 22 therein to accommodate the bearing lock typically found on ratchet plug 20. Socket head 12 should be made of a durable metal, such as tempered steel.

Jaw 14 is crescent shaped, having inner and outer peripheries 32 and 34 respectively. Jaw 14 is slidably mounted within socket head 12, i.e., the outer periphery 34 of jaw 14 abuts the inner wall or annular surface 36 of socket head 12. A fastener with a flanged head, such as an allen screw 24, extends through a circumferential slot 26 in the side of socket head 12 to hold jaw 14 in place. Slot 26 acts as a guide for sliding movement of jaw 14. Screw 24 preferably resides in a groove 28 on the outside wall or surface 30 of socket head 12 to maintin a smooth profile. Thus, it can immediately be seen that wrench 10 may be used on any threaded member, such as bolts or nuts of any shape (hexagonal or squared, as well as worn down bolts or nuts and pipes.

Figure 2:
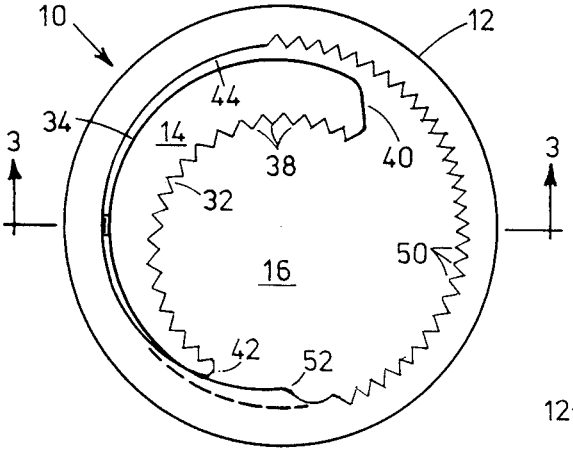
FIG. 2 is a top plan view thereof, showing the cammed inner surface.

Other features of socket pipe wrench 10 may be understood with further reference to FIG. 2. The inner periphery 32 of jaw 14 contains teeth 38 which grab the object to be twisted much the same as a standard pipe wrench (also known as a Stilson wrench). Teeth 38 extend radially inward and are not angularly biased as are most monkey wrenches. This allows teeth 38 to grab the fastener's head regardless of whether wrench 10 is rotated in a clockwise direction or in a counter-clockwise direction. The inner surface 36 of socket head 12 contains a second set of teeth or bits 50 which perform a similar function. Jaw 14, in addition to being crescent shaped, is somewhat wedged, i.e., its distal end 40 is wider than its proximate end 42. This insures that as socket head 12 turns, teeth 38 will catch the bolt or other object.

Two more aspects of the invention, which are not critical to the basic function of wrench 10 but are included in one preferred embodiment, are shown in FIG. 2. The first of these relates to the ability of jaw 14 to "rock" slightly so as to more easily grip the object to be worked. There is a gap 44 between the outer periphery 34 of jaw 14 and the inner surface 36 of socket head 12 due to the length of screw 24 and the depth of hole 46 in which screw 24 resides. This provides a small amount of play in jaw 14. When wrench 10 is twisted about a pipe or fastener, a torque is exerted as the distal end 40 of jaw 14. This in turn causes jaw 14 to resist further sliding along the inner surface 36 of socket head 12, which complements the gripping action of teeth 38. It should be further noted that the provision of gap 44 has the additional advantage of allowing wrench 10 to be used on varying sizes of pipes and bolts.

The second feature representing an improvement on the basic concept heretofore shown comprises a lobe 52 located along the inner surface 36 of socket head 12 which tapers off as it approaches jaw 14. As previously discussed, the wedge design of jaw 14 insures that teeth 38 will eventually catch the edge of the pipe or bolt to be affected. This effect, however, is beneficial only if socket head 12 is rotated in a clockwise direction (for the embodiment shown). Of course, a mirror image socket could be used for counter-clockwise rotations, but this has the obvious disadvantage of requiring the user to change out sockets. Lobe 52 overcomes this limitation by providing a camming effect on jaw 14 whenever socket head 12 is moved in a counter-clockwise direction. Lobe 52 is positioned near the proximate end 42 of jaw 14. The dashed lines in FIG. 2 near this point indicate the imaginary surface against which jaw 14 would abut if inner surface 36 of socket head 12 were a perfect circle. If the radius of curvature of outer periphery 34 of jaw 14 is equal to the radius of curvature of inner surface 36 of socket head 12, then there must be some play in jaw 14, such as that provided by gap 44, for lobe 52 to be functional.

While a single wrench 10 may be used on several different sizes of pipes and bolts, it is anticipated that wrench 10 will nevertheless be manufactured in various sizes itself so that it may be employed for an even wider range of pipes and bolts. The inner diameter of socket head 12 will range from one-quarter of an inch to six inches, and even larger for industrial usage. Cavity 16 should be fairly deep so as to contact the maximum surface area possible on the pipe or bolt head. Only in those cases where very little clearance is available must the depth be minimized.

Figure 4:
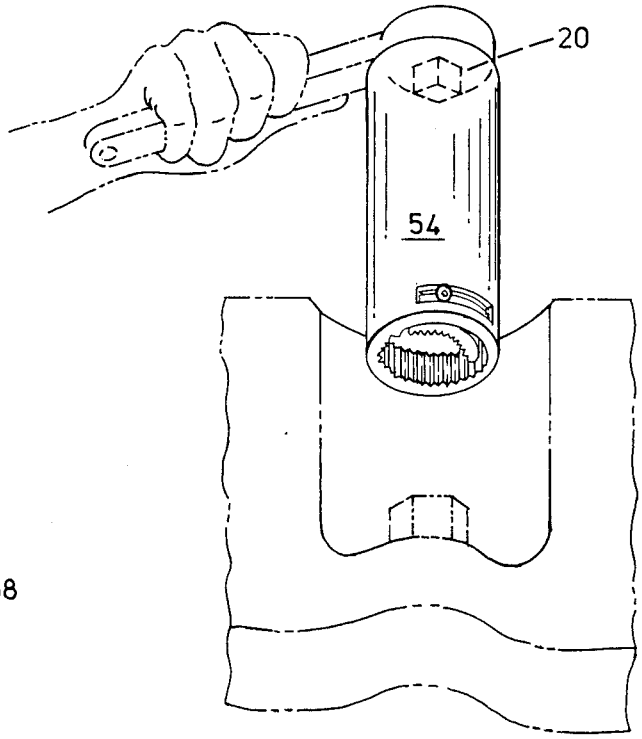
FIG. 4 is a perspective view showing use of the extended socket version of the invention with a ratchet handle.
Figure 6:
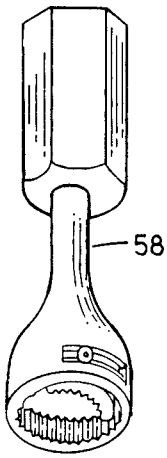
FIG. 6 is a perspective view showing the nut drive embodiment of the present invention.
Figure 5:
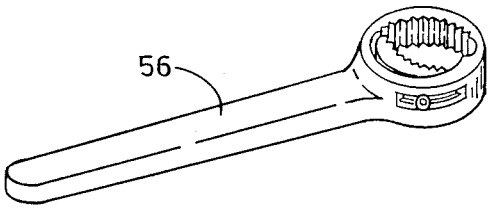
FIG. 5 is a perspective view showing the box wrench embodiment of the present invention.

Some alternative embodiments of the invention are shown in FIGS. 4—6. FIG. 4 depicts an extension socket 54 which is useful when the bolt or pipe is located down a narrow well. Extension socket 54 is identical to socket head 12 except that coupler 18 has been lengthened. FIG. 5 discloses a box wrench 56 having a socket incorporating the present invention. Finally, a nut drive embodiment 58 is shown in FIG. 6.

Figure 8:
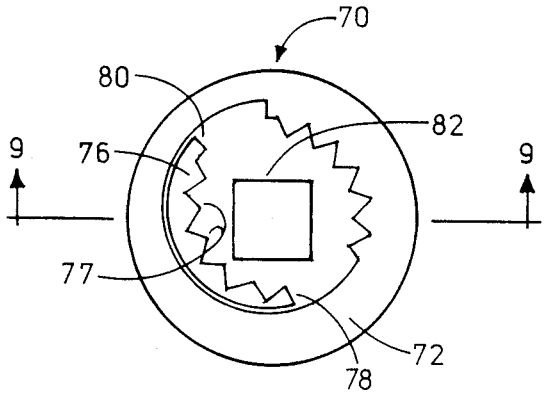
FIG. 8 is a top plan view of the alternate embodiment of FIG. 7.
Figure 7:
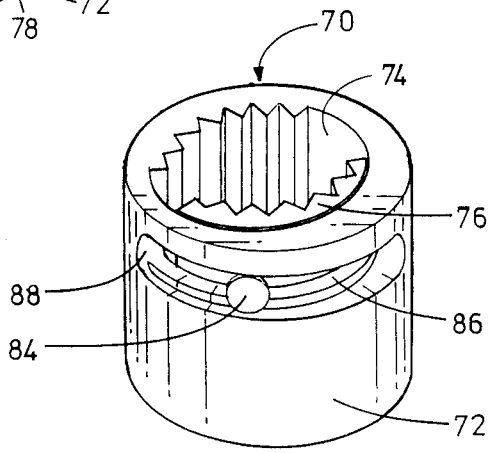
FIG. 7 is a perspective view of an alternate embodiment of the present invention.
Figure 9:
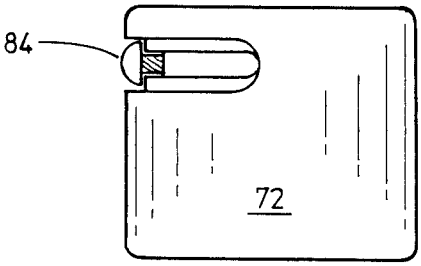
FIG. 9 is a side view of the alternate embodiment of FIG. 7.

A new and alternate preferred embodiment of the present invention is disclosed in FIGS. 7, 8, and 9. This improved embodiment is manufactured by casting the socket pipe wrench of the present invention out of any steel, although preferably 8620 steel, 4140 steel or stainless steel should be used. The mold is formed using a lost-wax mold process. Molding the invention allows greater uniformity between each socket wrench and less expensive manufacturing costs.

In FIG. 7, the wrench 70 is generally comprised of a socket head 72 and a slidable, bitted jaw 76. The jaw 76 slides along the inside wall 74 of the socket head 72. The inside wall 74 varies in thickness around the circumference of the socket head 72 as a cam wall to assist in the camming effect. A fastener with a flanged head, such as a threaded stay bolt 84, extends through a circumferential slot 86 in the side of socket head 72 to hold jaw 76 in place. Bolt 84 preferably resides in a groove 88 on the outside wall or surface of socket head 72 to maintain a smooth profile as illustrated by FIG. 9.

As can be seen in FIG. 8, the jaw 76 is crescent shaped having a distal end 80 and proximate end 78. The distal end 80 is cast so as to be thicker than the proximate end 78 to ensure that as the socket head 72 turns teeth 77 will catch the inserted member. The socket head 72 has a female coupler 82.

A unique advantage of this preferred embodiment is that the same size socket head 72 can be used with several different sizes of the jaw 76. The jaw 76 can be cast in different thicknesses so as to reduce the gap in the socket wrench 70. Thus, a single size socket head 72 can be manufactured to use on a wide range of nuts and bolts, or other objects, by just varying the thickness of the jaw 76. It is contemplated that three socket head sizes with each socket head having two different jaw sizes will be sold to cover the normal range of socket sizes. This will greatly reduce the number of sockets a mechanic will need to keep in his toolbox and reduce the chance of him not having the appropriate size due to the current problem of misplacing one of several sockets.

Although the invention has been described with reference to specific embodiments, this description is not meant to be construed in a limiting sense. Various modifications of the disclosed embodiment, as well as alternative embodiments of the invention will become apparent to persons skilled in the art upon reference to the description of the invention. It is therefore contemplated that the appended claims will cover such modifications that fall within the true scope of the invention.

I claim:

1. An apparatus for tightening and loosening a threaded member, comprising:

a socket member having a circular cavity therein defining an inner annular surface for receiving a portion of said threaded member, said inner annular surface having teeth and a cam lobe;

jaw means attached to said socket member and located within said circular cavity, whereby rotation of said socket member causes said jaw means to forcibly impinge upon said portion of said threaded member, said portion of said threaded member being grasped between said jaw means and a part of said teeth of said annular surface, thereby exerting rotational torque on said threaded member; wherein said jaw means includes:

a crescent-shaped member having inner and outer peripheries, said outer periphery having a curvature essentially identical to curvature of said inner annular surface of said cavity, said inner periphery having teeth for grasping said portion of said threaded member, said crescent-shaped threaded member having distal and proximate ends with said distal end being wider than said proximate end, said distal end being adapted to be complementary with said teeth of said inner annular surface, said distal end being separated from said proximate end by an angular distance of an arc of a circle, said arc including a substantial position of said circle;

said cam lobe is a cam wall attached to and integral with said inner annular surface of said circular cavity, said cam wall having a thickness such that said wall has a first position thereof located radially closer to an axis of rotation through said socket member and has a second position thereof located radially further from the axis than said first position, said first position located near said proximate end of said crescent shaped member whereby, as said crescent shaped member slides toward said first position of said cam wall said proximate end of said crescent shaped member is forced toward the center of said circular cavity; and means for attaching said crescent-shaped member to said socket member.

2. The apparatus of claim 1 wherein said crescent shaped member is slidably mounted to said inner annular surface of said cavity.

3. The apparatus of claim 2 wherein said socket member has a circumferential slot extending through a segment of said inner surface of said cavity, and said attachment means comprises a fastener having first and second ends, said first end having a flanged head, and said second end extending through said circumferential slot and being attached to said crescent shaped member, said slot acting as a guide for sliding movement of said crescent shaped member.

4. The apparatus of claim 3 wherein said circumferential slot and said flanged head of said fastener are further recessed in a groove on an outer surface of said socket member.

5. The apparatus of claim 1 further comprising handle means for rotating said socket member.

6. The apparatus of claim 1 wherein said socket member and said crescent shaped member are constructed of a durable metal.

7. The apparatus of claim 1 wherein said handle means is a ratchet and said socket member has a coupler for attachment to said ratchet.

8. The apparatus of claim 1 wherein said handle means is integral with and attached to said socket member, said handle means being generally in the same plane as said crescent shaped member, forming a box wrench.

9. The apparatus of claim 4 wherein said handle means is integral with and attached to said socket member, said handle means being generally perpendicular to the plane of said crescent shaped member, forming a nut drive.

10. A wrench for twisting a threaded member comprising:

a socket having inner and outer walls defining a circular cavity for receiving a portion of said threaded member, said inner wall having teeth and a cam lobe;

a crescent shaped jaw member having a toothed working surface, adjacent to said inner wall of said socket, said jaw member having a curvature corresponding to curvature of said inner wall, said jaw member further having distal and proximate ends, said distal end being wider than said proximate end, said distal end being adapted to be complementary with said teeth of said inner wall, said distal end being separated from said proximate end by an angular distance of an arc of a circle, said arc including a substantial position of said circle;

means for slidably attaching said jaw member to said socket whereby rotation of said socket causes said jaw member, to forcibly impinge upon said portion of said threaded member, said portion of said threaded member being grasped between said jaw member and said inner wall, thereby exerting rotational torque on said threaded member;

handle means for rotating said socket;

said cam lobe is a cam wall attached to and integral with said inner wall, said cam wall having a thickness such that said wall has a first position thereof located radially closer to an axis of rotation through said socket and has a second position thereof located radially further from the axis than said first position, said first position located near said proximate end of said crescent shaped member whereby, as said crescent shaped member slides toward said first position of said cam wall said proximate end of said crescent shaped member is forced toward the center of said socket; and said socket and jaw member being contructed of a durable metal.

11. The wrench of claim 10 wherein:

said socket has a circumferential slot extending through a segment of said inner wall; and said attachment means comprises a fastener having first and second ends, said first end having a flanged head, and said second end extending through said circumferential slot and being attached to said jaw member, said slot acting as a guide for sliding movement of said jaw member.

12. A socket for rotating an object having a generally cylindrical section along its longitudinal axis, comprising:

a socket head constructed of a durable metal having inner and outer walls defining a circular cavity for receiving a portion of said cylindrical section object, said socket head having teeth and a cam lobe, said socket head having a circumferential slot extending through a segment of said inner wall, and further having a coupler for attachment to a handle;

a crescent shaped jaw constructed of a durable metal having a toothed working surface, adjacent to said inner wall of said socket head, said jaw having a curvature corresponding to curvature of said inner wall, said jaw further having distal and proximate ends, said distal end being wider than said proximate end, said distal end being adapted to be complementary with said teeth of said inner annular surface, said distal end being separated from said proximate end by an angular distance of an arc of a circle, said arc including a substantial position of said circle;

means for slidably attaching said jaw to said socket head whereby rotation of said socket head causes said jaw to forcibly impinge upon said portion of said object, said portion of said object being grasped between said jaw and said bitted inner wall, thereby exerting rotational torque on said object, said attachment means comprising a screw having first and second ends, said first end having a flanged head, and said second end extending through said circumferential slot and being attached to said jaw, said slot acting as a guide for sliding movement of said jaw;

said cam lobe is a cam wall attached to and integral with said inner wall, said cam wall having a thickness such that said wall has a first position thereof located radially closer to an axis of rotation through said socket member and has a second position thereof located radially further from the axis than said first position, said first position located near said proximate end of said crescent shaped member whereby, as said crescent shaped jaw slides toward said second position of said cam wall said proximate end of said crescent shaped jaw is forced away the center of said circular cavity; and said circumferential slot and said flanged head of said screw being recessed in a groove on said outer wall of said socket head.

* * * * *